US006224224B1

(12) United States Patent
Bear

(10) Patent No.: US 6,224,224 B1
(45) Date of Patent: May 1, 2001

(54) LARGE DISTRIBUTED COLD-LIGHT PATTERN DEVICE

(75) Inventor: Hsiung Bear, Taipei (TW)

(73) Assignee: Limate Corporation, Taipei (TW)

( * ) Notice: Subject to any disclaimer, the term of this patent is extended or adjusted under 35 U.S.C. 154(b) by 0 days.

(21) Appl. No.: 09/393,975

(22) Filed: Sep. 10, 1999

(51) Int. Cl.[7] ..... H05B 33/08

(52) U.S. Cl. ..... 362/84; 362/806; 362/235; 362/249; 362/184; 362/230

(58) Field of Search ..... 362/84, 806, 235, 362/249, 184, 251, 230, 231, 293; 40/541, 542, 544

(56) References Cited

U.S. PATENT DOCUMENTS

| | | | | |
|---|---|---|---|---|
| 4,443,832 | * | 4/1984 | Kanamori et la. | 362/84 |
| 4,494,326 | * | 1/1985 | Kanamori | 362/84 |
| 5,416,674 | * | 5/1995 | Murai | 362/84 |
| 5,557,869 | * | 9/1996 | Douglas | 362/34 |
| 5,957,564 | * | 9/1999 | Bruce et al. | 362/84 |

* cited by examiner

*Primary Examiner*—Thomas M. Sember
(74) *Attorney, Agent, or Firm*—Rosenberg, Klein & Lee

(57) ABSTRACT

A large distributed cold-light pattern device comprises from front to back a transparent plate, a color excited layer, a plurality of cold-light units, a plurality of soft cables, a back plate, a cold-light control circuit board, at least a converter, and a power supply. The color excited layer is capable of transforming electromagnetic wavelengths. The color excited layer covers on the back of the thicker transparent plate having supporting function. The luminous surface of each cold-light unit is mounted at the desired place on the color excited layer and is linked with the color excited layer. Each soft cable is individually connected to the lead-out line terminal of each cold-light unit. The overlapping part of each cold-light unit and each soft cable is then laminated. The back plate is installed fixedly on the back of each cold-light unit. The cold-light control circuit board is installed fixedly on the back plate and is connected properly to each soft cable to let each cold-light unit be on and off timely. The converter is installed fixedly on the back plate and is used to transform external voltage and current to proper frequency. The power supply is used to supply required electricity.

7 Claims, 4 Drawing Sheets

LARGE DISTRIBUTED COLD-LIGHT PATTERN DEVICE

FIELD OF THE INVENTION

The present invention relates to a large distributed cold-light pattern device, especially to a large distributed cold-light pattern device such as the large cold-light signboard with size exceeding working range of general printing machines and the cold-light signboard having distributed luminous regions.

BACKGROUND OF THE INVENTION

The mass production technology of conventional large electrically excited luminescent devices is mature. There are already signboards using electrically excited luminescent devices. Due to their characteristics of ultra-thinness and softness, the electrically excited luminescent devices have difficulty when used in commercialized signboards. Moreover, the cold-light plate usually can not be separated into several cold-light units for assembly. Therefore, the size of cold-light signboards can not be large due to limited material cost. The lead-out line terminal on the back of the cold-light plate usually exceeds outer edge of the cold-light plate, so more space is needed and the ensemble delicacy is destroyed. It is not suitable to the assembly line process. Also, accessory devices such as the converter used in the cold-light signboard usually can not be integrated with the cold-light signboard, resulting in inconvenient usage.

SUMMARY OF THE PRESENT INVENTION

Accordingly, the primary object of the present invention is to provide a large distributed cold-light pattern device comprising from front to back a transparent plate, a color excited layer, a plurality of cold-light units, a plurality of soft cables, a back plate, a cold-light control circuit board, at least a converter, and a power supply. The color excited layer covers on the back of the thicker transparent plate having supporting function. Each cold-light unit is affixed to its desired place on the back of the transparent plate and is linked with the color excited layer. The lead-out line terminal of each cold-light unit is individually connected outwards to each soft cable to let the lead-out line terminal not exceed outer edge of each cold-light unit. The overlapping part of each cold-light unit and each soft cable is then laminated to maintain the ensemble delicacy and to save material for production process. Several holes are dug on the back plate to place the cold-light control circuit board and each converter for assembling into a single body.

The various objects and advantages of the present invention will be more readily understood from the following detailed description when read in conjunction with the appended drawing, in which:

DETAILED DESCRIPTION OF PREFERRED EMBODIMENT

Figure 1:
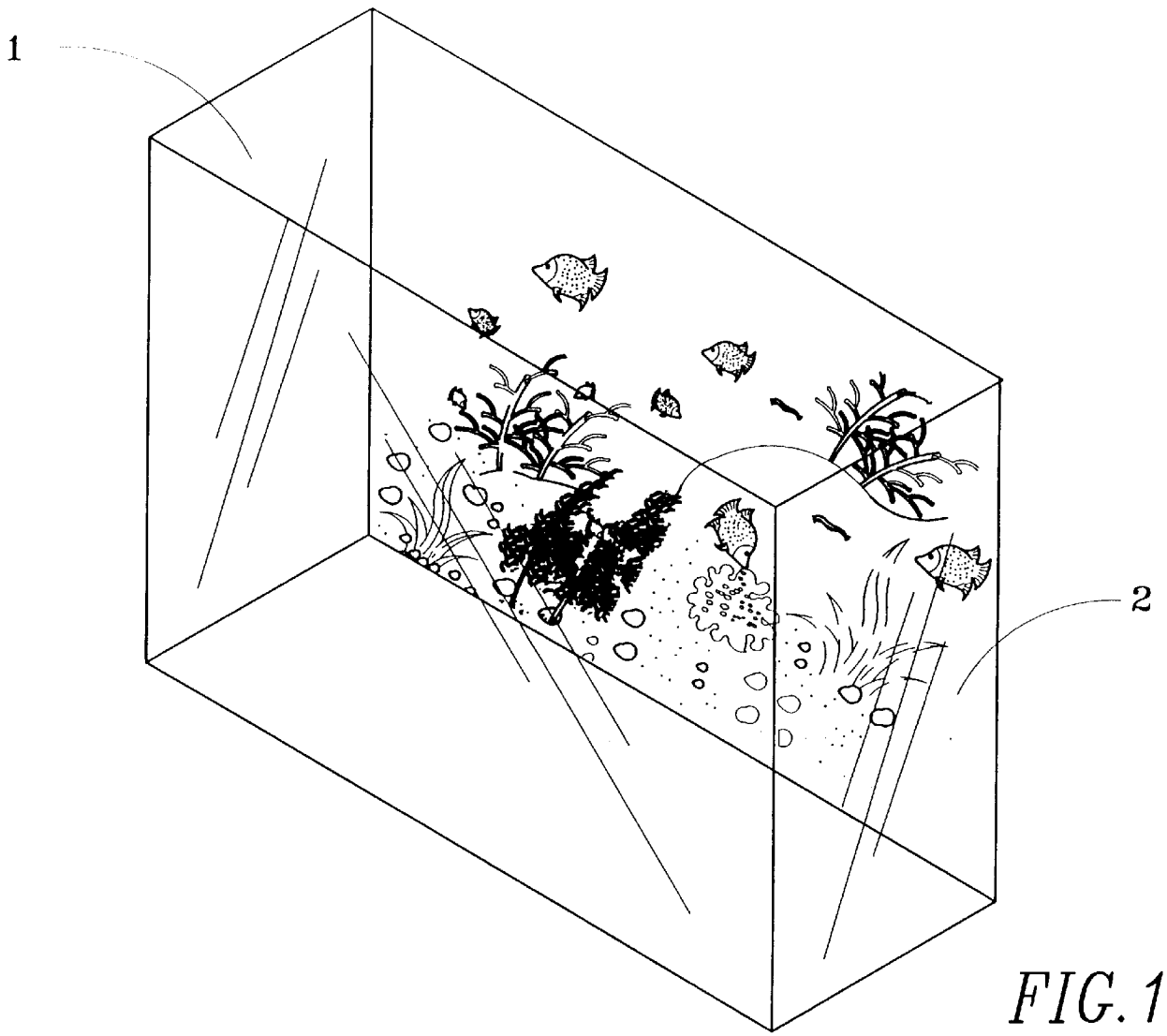
FIG. 1 is a perspective view of the color excited layer covering on the back of the transparent plate according to the present invention.
Figure 2:
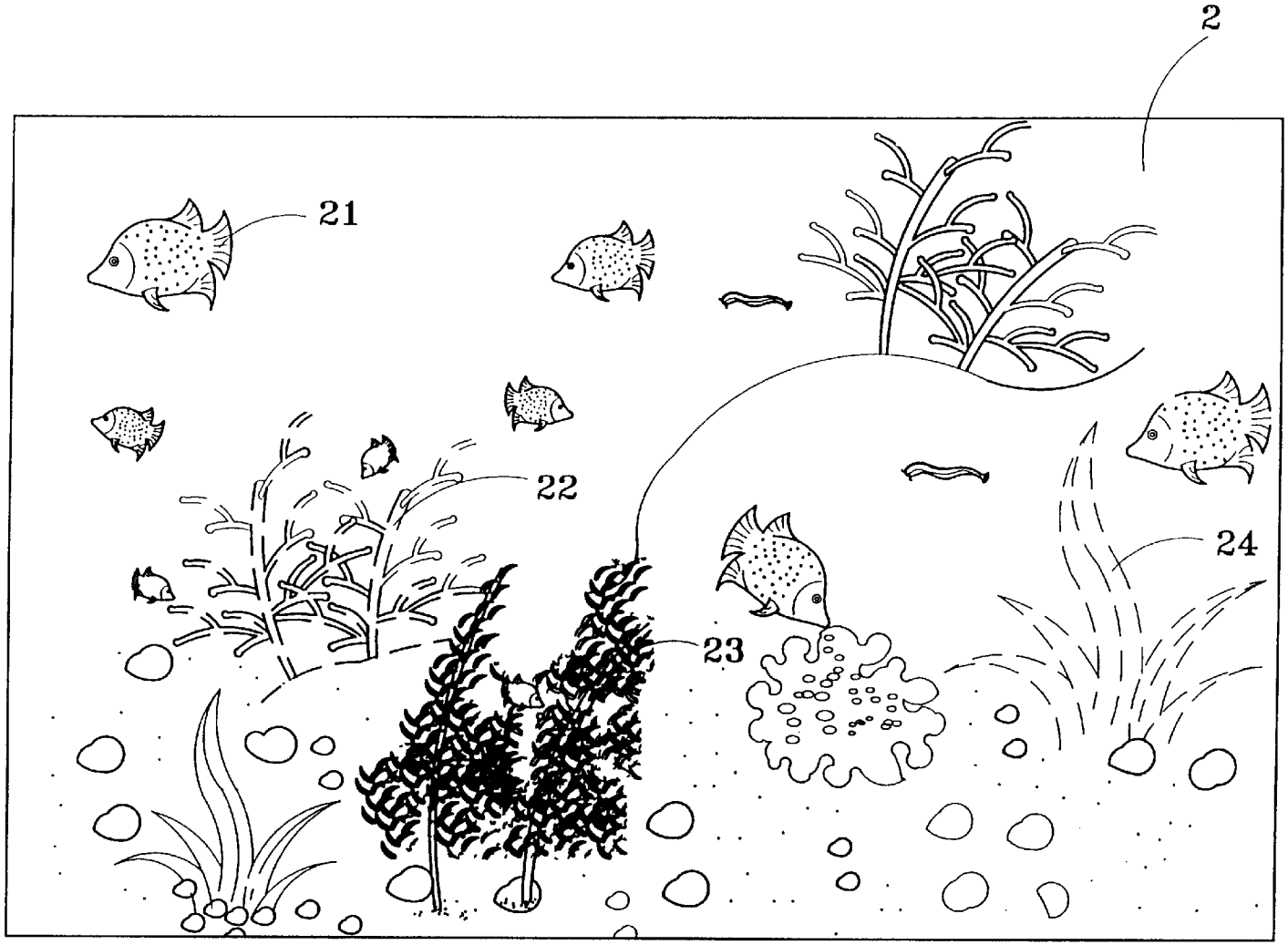
FIG. 2 is a diagram showing the pattern plane of the color excited layer according to the present invention.
Figure 3:
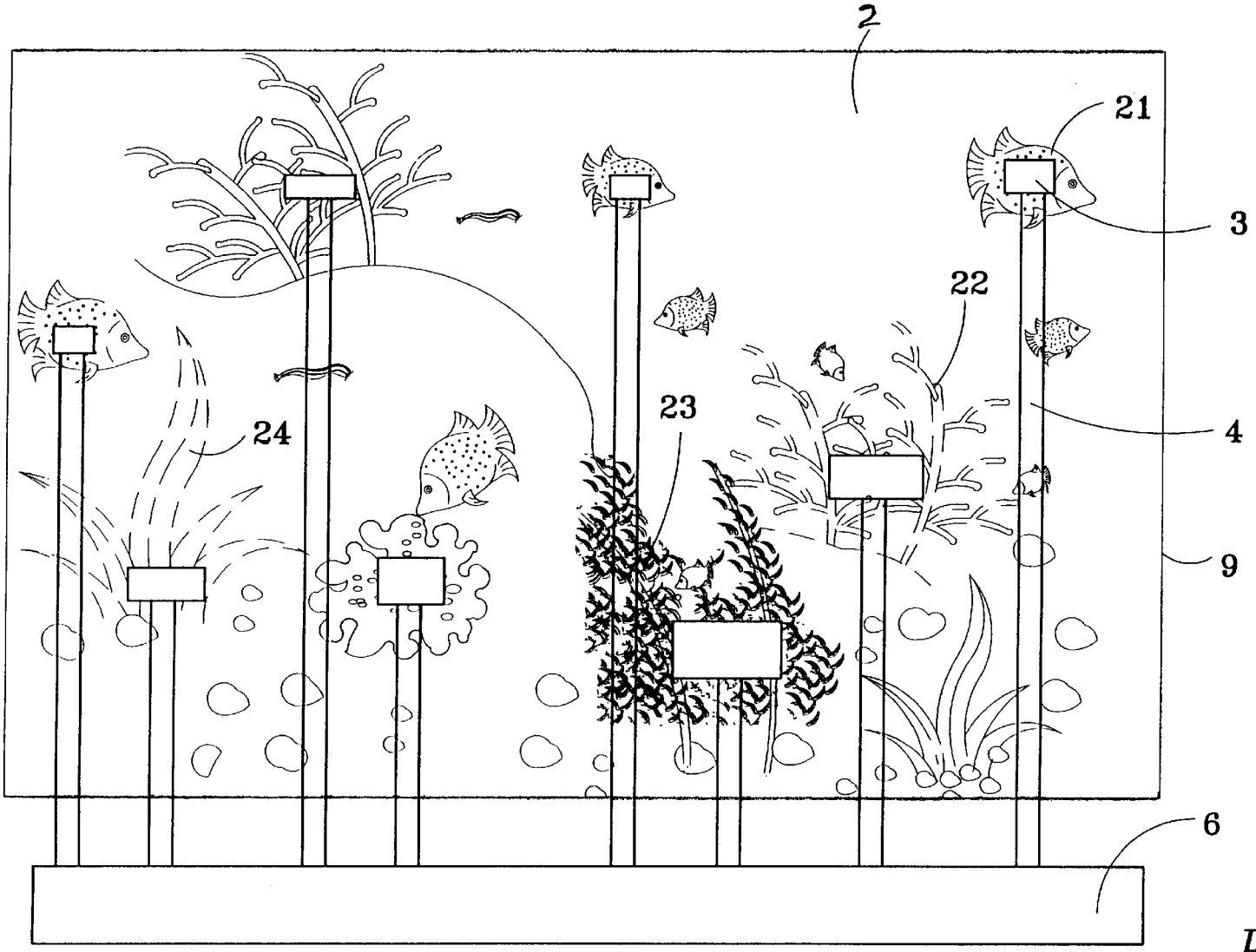
FIG. 3 is a diagram showing the layout plane of each cold-light unit on the back of the color excited layer according to the present invention.
Figure 4:
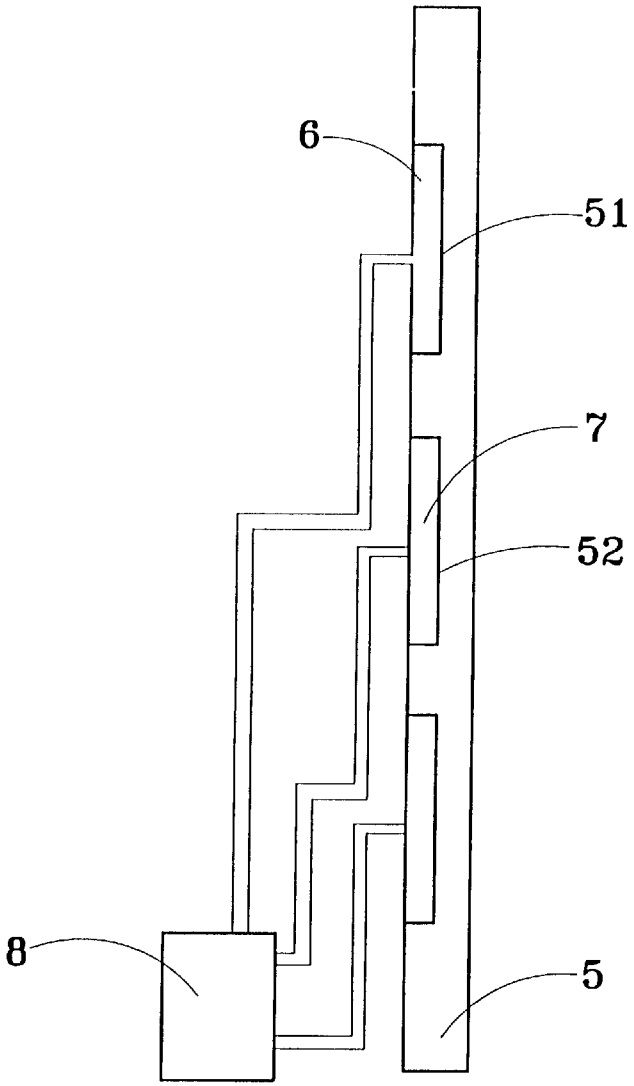
FIG. 4 is a side view of the back plate and the internal devices according to the present invention.

As shown in FIGS. 1 to 4, the present invention provides a large distributed cold-light pattern device comprising from front to back a transparent plate 1, a color excited layer 2, a plurality of cold-light units 3, a plurality of soft cables 4, a back plate 5, a cold-light control circuit board 6, at least a converter 7, and a power supply 8. The transparent plate 1 is a thick glass or organic glass having enough supporting strength. The color excited layer is capable of transforming electromagnetic wavelengths and covers on the back of the transparent plate through printing, spraying painting, electroplating, vacuum electroplating, hand painting, or affixing color adhesive films using molding tools. The thickness of the color film is uniform and there is no bubbles therein destroying the look. The cold-light units 3 are disassembled from an integral cold-light plate. The internal structure of the cold-light unit 3 from bottom to top comprising a polyester, a transparent conducting layer, a fluorescent layer, and a conducting plasma wherein the transparent conducting layer can be of etching type or non-etching type. According to the required luminous area of each pattern on the color excited layer 2 and the requirement of the merry-go-round, the luminous surface of each cold-light unit is mounted on the required place of the color excited layer 2 on the transparent plate 1. A cohesive agent such as the borane and the silane can be used to enhance the linkage strength. Several individually distributed luminous regions such as the fishes 21, the corals 22, and the water-weeds 23 are thus formed. Each soft cable 4 is situated at the same place as that of the lead-out line terminal of each cold-light unit 3. The conductor such as naked copper on one end of each soft cable is connected individually to the lead-out line terminal of each cold-light unit 3. The overlapping part of each cold-light unit 3 and each soft cable 4 is then laminated to form an insulting moisture-proof film 9. An acute tool is used to scratch along the edge of the soft cables 4 to bring out the terminal of each soft cable. The back plate 5 has a predetermined thickness and is mounted on the back of each cold-light unit 3. The back plate 5 has several holes 51 at proper place thereon. The cold-light control circuit board 6 is installed fixedly inside the hole 51 on the back plate 5 and is connected properly to each soft cables to let each cold-light unit be on and off timely. For instance, when the cold light of the water-weeds 24 is off temporarily (shown with the dashed lines), the cold-lights of the fishes 21, the corals 22, and the water-weeds 23 will be on temporarily (shown with the solid lines), and vice versa. The converter 7 is installed fixedly inside another hole 52 on the back plate 5. The converter 7 is used to transform external voltage and current to proper frequency. The converter can have a battery box. The power supply 8 is used to supply required electricity. The power supply 8 can be a battery or a general power supply.

To sum up, the present invention has the following advantages:

1. The color excited layer covers on the thicker transparent plate having supporting function.
2. Each cold-light unit is affixed to the required place on the back of the transparent plate and is linked with the color excited layer.
3. The lead-out line terminal on the back of each cold-light unit is connected outwards to each soft cable to let the lead-out line terminal not exceed outer edge of each cold-light unit. The overlapping part of each cold-light unit and each soft cables is laminated to maintain ensemble delicacy and save material for production process.
4. Several holes is dug on the back plate to place the cold-light control circuit board and the converter for assembling into a single body.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

I claim:

1. A large distributed cold-light pattern device comprising:

a transparent plate;

a color excited layer covering on a back of said transparent plate and capable of transforming electromagnetic wavelengths;

a plurality of cold-light units mounted at required places on said color excited layer according to required luminous areas of said color excited layer;

a plurality of soft cables individually connected to each cold-light unit;

a back plate installed fixedly on a back of each said cold-light unit and having a plurality of holes at predetermined locations thereon;

a cold-light control circuit board installed fixedly inside one of said plurality of holes on said back plate and connected properly to each said soft cable to let each said cold-light unit be on and off timely;

at least a converter installed fixedly inside another of said plurality of holes on said back plate and capable of transforming external voltage and current to proper frequency; and a power supply used to supply required electricity to said cold-light control circuit board and said converter.

2. The large distributed cold-light pattern device of claim 1 wherein said color excited layer covers said transparent plate through use of a process selected from the group consisting of printing, spraying, painting, electroplating, vacuum electroplating, hand painting, or fixation of color adhesive films using molding tools.

3. The large distributed cold-light pattern device of claim 1 wherein said cold-light units are disassembled from an integral cold-light plate, an internal structure of said cold-light unit comprising from bottom to top a polyester, a transparent conducting layer, a fluorescent layer, and a conducting plasma wherein said transparent conducting layer is selected from the group comprising of an etching type or non-etching type.

4. The large distributed cold-light pattern device of claim 1 wherein said color excited layer patterns of fishes, corals, and water-weeds.

5. The large distributed cold-light pattern device of claim 1 wherein each said soft cable is situated at the same place as that of a lead-out line terminal of each said cold-light unit, a conductor of one end of each said soft cable connected individually to the lead-out line terminal of each said cold-light unit wherein the conductor of one end of each said soft cable is bare copper.

6. The large distributed cold-light pattern device of claim 1 wherein an overlapping part of each said cold-light unit and each said soft cable is laminated to form an insulating moisture-proof film.

7. The large distributed cold-light pattern device of claim 1 wherein each said cold-light unit is linked with said color excited layer to enhance linkage strength through use of a cohesive agent selected from borane and silane.

* * * * *